US006510792B1

(12) United States Patent
Gunschera

(10) Patent No.: US 6,510,792 B1
(45) Date of Patent: Jan. 28, 2003

(54) DEVICE FOR FORMING A SHEET PILE FOR A SHEET FED ROTARY PRINTING PRESS

(75) Inventor: Frank Gunschera, Heidelberg (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 122 days.

(21) Appl. No.: 09/730,517

(22) Filed: Dec. 5, 2000

Related U.S. Application Data

(63) Continuation of application No. 08/936,562, filed on Sep. 24, 1997, now abandoned.

(30) Foreign Application Priority Data

Sep. 26, 1996 (DE) ..... 196 39 495

(51) Int. Cl.[7] ..... B41F 13/70; B65H 31/08

(52) U.S. Cl. ..... 101/232; 101/241; 271/207

(58) Field of Search ..... 101/232, 236, 101/237, 238, 239, 240, 241, 242; 271/3.02, 207, 212, 213, 218, 224, 214, 215, 221, 222

(56) References Cited

U.S. PATENT DOCUMENTS 3,796,427 A 3/1974 Reutter et al.
5,481,348 A * 1/1996 Mihara ..... 271/207
5,503,388 A * 4/1996 Guenther et al. ..... 101/232

FOREIGN PATENT DOCUMENTS

| | | |
|---|---|---|
| DE | 2047808 | 8/1971 |
| DE | 4317357 | 11/1994 |
| JP | 5943327 | 12/1984 |

* cited by examiner

*Primary Examiner*—Eugene H. Eickholt
(74) *Attorney, Agent, or Firm*—Nils H. Ljungman & Associates

(57) ABSTRACT

A device for forming a pile of sheets by means of a pile carrier and a stop. The stop can be swung around a horizontal geometric axis in a first direction away from the pile against a first actuating force of an actuating device and then swung back in the opposite direction by means of the actuating device while simultaneously raising the stop until reaching its alignment position on a second, higher level. So that the stop retains its alignment regardless of the level on which the stop is located, the device is provided with a guide which guide forces the vertical dislocation of the geometric axis, and with an end stop by means of which the stop is kept in the same alignment at any of the elevations assumed by the stop.

12 Claims, 7 Drawing Sheets

DEVICE FOR FORMING A SHEET PILE FOR A SHEET FED ROTARY PRINTING PRESS

This application is a continuation of U.S. application Ser. No. 08/936,562, filed on Sep. 24, 1997 and now abandoned. U.S. application Ser. No. 08/936,562 was pending as of the filing date of this application.

BACKGROUND OF THE INVENTION

1. Field of the Invention

The present invention relates generally to a device for forming a sheet pile. The device has a pile carrier with a supporting surface for the pile and a stop, which stop can be raised from an alignment position on a first level to an alignment position on a second level while retaining its axial alignment. In raising the stop from its alignment position, the stop is first swung around a horizontal geometric axis and away from the pile against a first actuating force, and then swung by means of the first actuating force toward the pile, and which stop is, at least in the alignment position on the second level, pressed against the pile supporting surface by means of a second actuating force.

2. Background Information

Japanese utility model Sho 59-43327 Y2, for example, discloses a device of the type described above. This device has a rod or swinging arm arrangement having a hinge pin, which hinge pin forms the geometric axis, mounted to a first rod end and a hinged connection to a frame on the second rod end. One leg of a leg spring, which leg spring provides the first actuating force, is attached to the rod arrangement and the other leg is attached to the stop, which stop can be swung around the geometric axis. The swing of the stop toward the pile under the first actuating force is limited by an end stop, upon contact with which the stop assumes a defined position relative to the rod arrangement. In a base position on the first level of the stop, the rod arrangement rests against a fixed support. On the higher, second level, reached by means of the first actuating force and the resting of the stop on the pile carrier upon contacting the end stop, the stop is pressed against the support carrier by means of a second actuating force, in this case the weight of the rod arrangement. With each change of level of the stop, the geometric axis moves through an arc normal to the axis, and the position determined by the end stop which a stop face on the stop can assume at either of the levels of the stop is parallel to a tangent of the arc intersecting the geometric axis.

The alignment of the stop in its alignment position is thus a function of the level on which the stop is located.

OBJECT OF THE INVENTION

The object of the present invention is to develop a generic device in which the stop face can always assume the identical alignment position regardless of the level of the geometric axis.

SUMMARY OF THE INVENTION

This object is achieved with a device for forming a pile of sheets, which device has a pile carrier with a pile supporting surface and a stop. The stop can be raised from an alignment position on a first level to an alignment position on a second level while retaining its axial alignment in that the stop is first swung around a horizontal geometric axis and away from the pile against a first actuating force, and then swung by means of the first actuating force toward the pile. The stop can then, at least in the alignment position on the second level, be pressed against the pile supporting surface by means of a second actuating force. In addition, a guide slot forces a vertical dislocation of the geometric axis during the dislocation of the stop and the stop is held in the same alignment under the influence of the first actuating force on the first, second and every intermediate level by means of an end stop.

The device according to the present invention is also more compact than known devices. This is apparent when considering that achieving a relatively constant alignment of the stop at various elevation levels with the device of the prior art would require a rod arrangement including relatively long rods. In contrast, it is possible with the device in accordance with the present invention to realize an alignment of the stop independent of its level without having to unreasonably extend the device in a direction away from the side of the pile to be aligned.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentable and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Preferred embodiments of the present invention are described in greater detail below with reference to the attached drawings, in which.

DESCRIPTION OF THE PREFERRED EMBODIMENT

Figure 1:
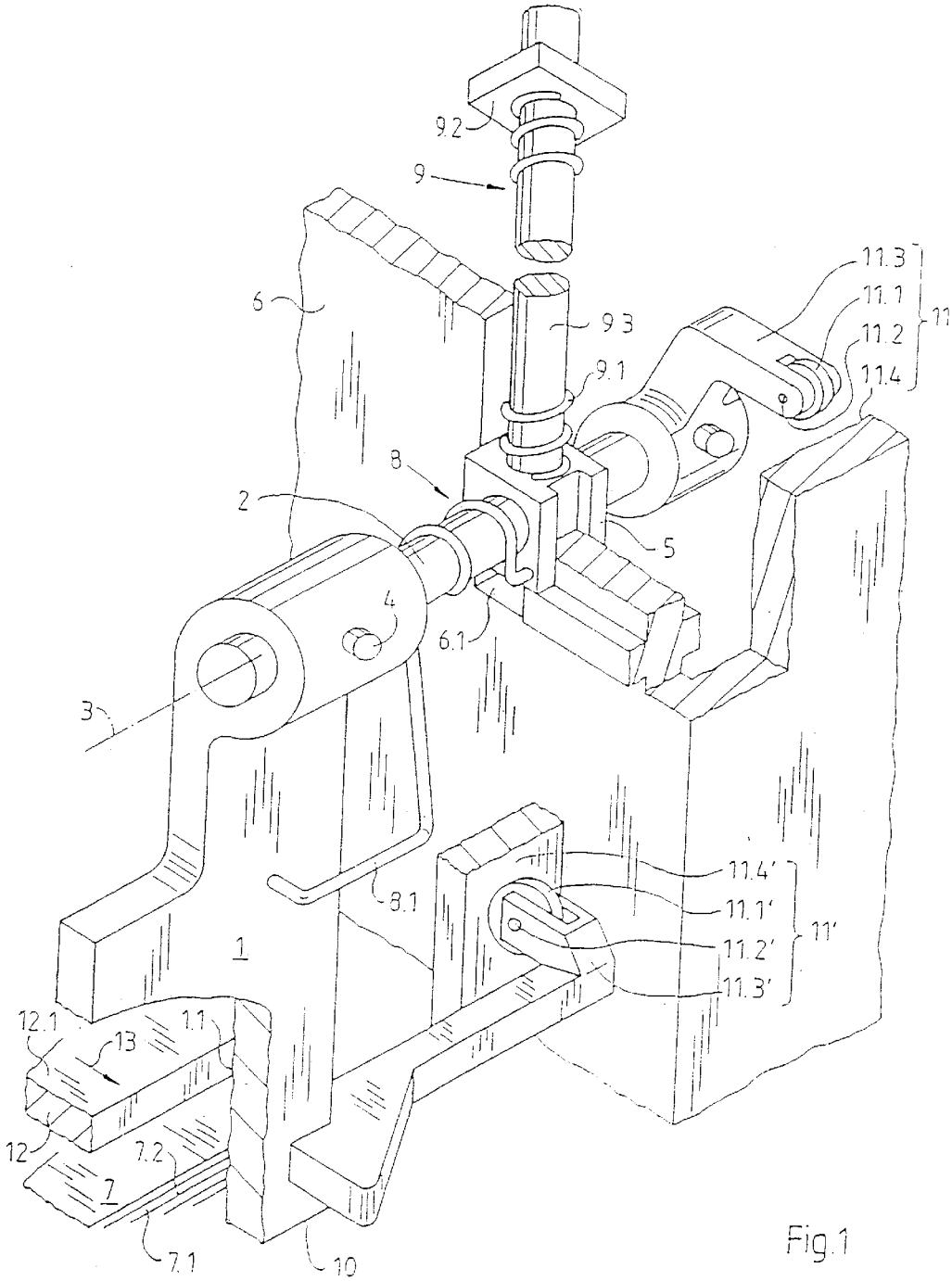
FIG. 1 shows an embodiment of a first variant with a first and second actuating device for the first and second actuating force.

In the example shown in FIG. 1, a stop 1 in the form of a strip is rigidly connected to an axle shaft 2 which axle shaft 2 forms a horizontal geometric axis 3, around which axis 3 the stop 1 can be swung. The stop 1 and the axle shaft 2 can be rigidly connected by means of a pin 4, for example. The axle shaft 2 is rotatably mounted in a sliding block 5, which sliding block 5 is mounted in a vertical guide in the form of a slot 6.1 in a guide plate 6. The stop 1 includes a flat stop face 1.1 which stop face 1.1 is vertical when the stop 1 is in its alignment position and, in the case that a pile 7 of sheets 7.2 has begun to form, rests against one side 7.1 of the pile 7. The stop 1 swings around the geometric axis 3, in the example shown with a corresponding counterclockwise rotation of the axle shaft 2 in the sliding block 5, from the alignment position away from the pile 7, more precisely, away from the side 7.1 of the pile 7, against a first actuating force, which first actuating force in this case is provided by a first actuating device 8. This first actuating device 8 can be a coiled leg spring 8.1, the coiled leg spring 8.1 having its core wound around the axle shaft 2, one leg braced against the sliding block 5, and the other leg braced against the stop 1.

In one of the practical applications of the device, the stop 1 is swung away from the side 7.1 of the pile 7 by means of a deflection force exerted against the stop face 1.1, e.g. by a pile carrier 12 with a support surface 12.1 for the pile, which pile carrier 12 is moved in the direction of the arrow 13 until assuming a position beneath the stop 1. The individual steps of this process are shown in FIGS. 4 through 8.

Due to the first actuating force, for the generation of which the leg spring 8.1 contacting the stop 1 is braced against the. sliding block 5, the sliding block 5 is raised from the first level initially assumed by the stop 1.

As the deflection force swings the stop 1 away from the pile 7, the lower end 10 of the stop 1 comes in contact with the pile support surface 12.1 of the pile carrier 12. The stop 1 is thus raised and the stop 1 is swung back in the direction of the pile 7 by the first actuating force. This reverse swing ends when the stop 1 is again in its alignment position with the stop face 1.1 vertical. The stop 1 is now on a second level above the first level.

As the stop 1 swings back and forth and is raised, the alignment of the geometric axis 3 is retained due to the mounting of the same in the guided sliding block 5.

An end stop 11 ensures the vertical alignment of the stop face 1.1 on each level. Two embodiments of this end stop 11 are shown in FIG. 1, only one of which is required.

One variant has an arrangement of rollers which can be swung and moved in conjunction with the stop 1, which arrangement in this example comprises a single roll 11.1 or 11.1' mounted on a stop arm 11.3 or 11.3' rigidly connected to the stop 1 so as to rotate around a horizontal axis 11.2 or 11.2', and a vertical staying surface 11.4 or 11.4' along which the roller arrangement rolls. The end stop 11 or 11' is designed so that the stop face 1.1 of the stop 1 is vertical when the roll 11.1 or 11.1' rests against the staying surface 11.4 or 11.4'. The end stop 11 or 11' thus stops the swinging of the stop 1 in the direction of the pile 7 under the first actuating force with the stop 1 in its alignment position with the stop face 1.1 vertical.

If the height of the pile carrier 12 does not change while the stop 1 is swung back and forth, the stop 1 shifts from its first level to a second, higher level where the stop 1 is again in its alignment position with the stop face 1.1 vertical and the roll 11.1 or 11.1' in contact with the staying surface 11.4 or 11.4'.

During the downward movement of the pile carrier 12 which usually follows, to maintain the production level for the delivery of sheets 7.2 to the pile 7, the stop 1 remains in its alignment position because the roll 11.1 or 11.1' rests against the vertical staying surface 11.4 or 11.4'. The second actuating force generated by a second actuating device 9 ensures that the lower end 10 of the stop 1 likewise remains in contact with the pile support surface 12.1 until the stop 1 reaches its initial, lower level. The roller arrangement comprised of the roll 11.1 or 11.1' reduces the required magnitude of the second actuating force.

As with the aforementioned known device, the stop 1 is, while at its second level and during the transition to the first, lower level, affected by a gravitational force corresponding to the raised mass in addition to the second actuating force supplied by the second actuating device.

In this example (as shown in FIG. 1), the second actuating device comprises a helical spring 9.1, which helical spring 9.1 supplies the second actuating force. This helical spring 9.1 is braced against the sliding block 5 by an abutment 9.2, and is guided by means of a rod 9.3. The rod 9.3 itself is guided in the abutment 9.2 so as to be longitudinally displaceable and fastened to the sliding block 5, e.g. by means of a bolted connection. The abutment 9.2 is stationary relative to the guide plate 6.

Figure 2:
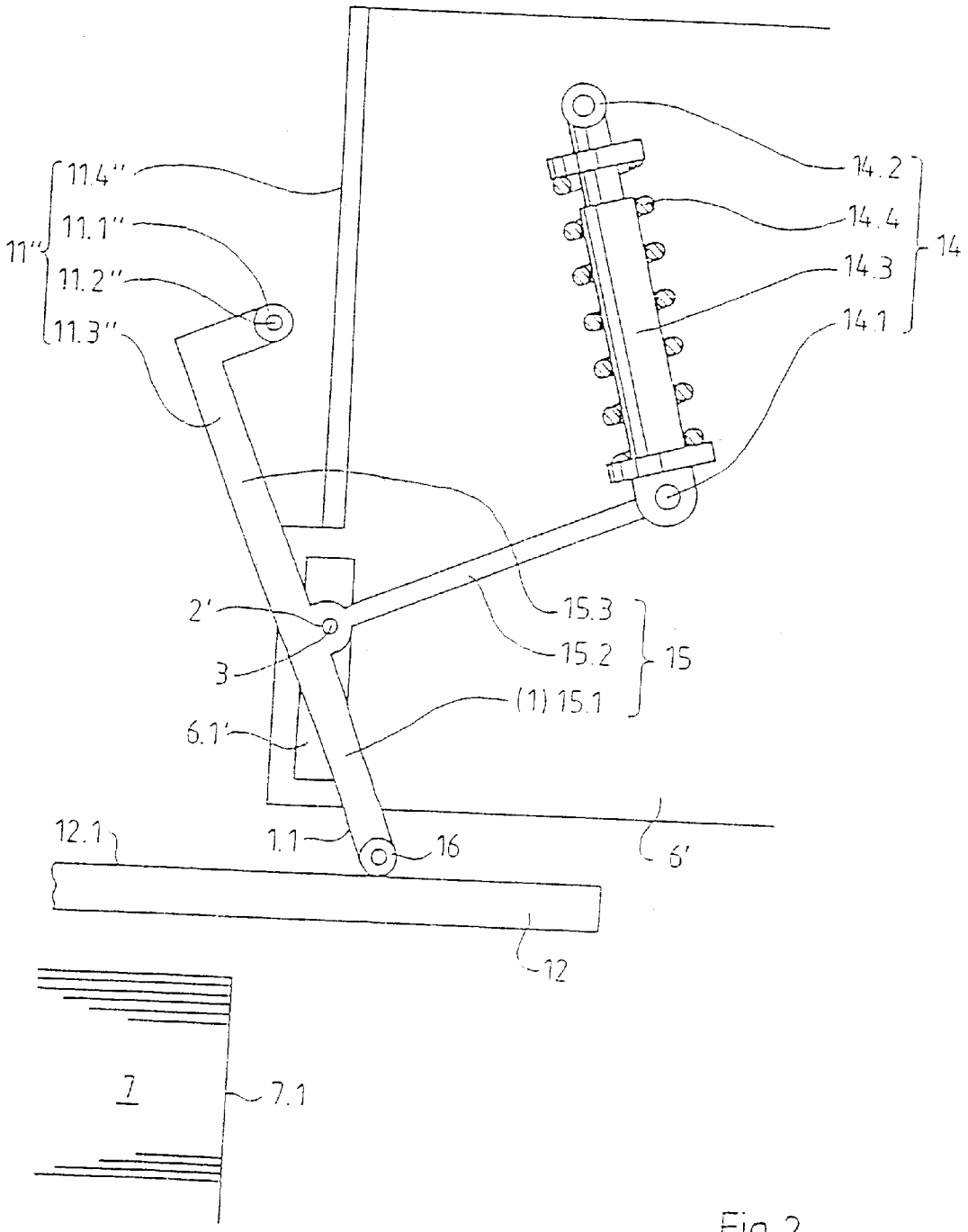
FIG. 2 shows a schematic of a first embodiment of a second variant with a common actuating device for the first and second actuating force.

In the embodiment shown in FIG. 2, the first and second actuating forces are supplied by a common actuating device 14. To force the vertical displacement of the geometric axis 3 while retaining the alignment of the same during the dislocation of the stop 1, which stop 1 in this case is realized as the first lever arm 15.1 of an angle lever or rectangular lever arrangement 15 which can be swung around the geometric axis 3, a guide plate 6' can be provided with a vertical slot 6.1' and the coupling of the geometric axis 3 to the vertical slot 6.1' can be realized, for example, in the same manner as in the embodiment shown in FIG. 1 by means of an axle shaft 2' which forms the geometric axis.

FIG. 2 shows the device at one point during the swinging of the stop 1 toward the pile 7 while simultaneously raising the stop 1 as explained with reference to FIG. 1, after the stop 1 has already been swung away from the pile 7 by displacing the pile carrier 12 to the right (when viewed as shown in the figure) so that the pile carrier 12 moves beneath the stop 1.

The actuating forces supplied by the common actuating device 14 act on a second lever arm 15.2 of the angle lever arrangement 15 which runs away from the pile 7. To this end, the common actuating device 14 is linked by means of a first hinged connection 14.1 to that end of the second lever arm 15.2 farthest from the pile 7. The second lever arm 15.2 is substantially perpendicular to the first lever arm 15.1. In this case, the common actuating device 14 comprises a telescoping rod arrangement 14.3 extending from the first hinged connection 14.1 and linked to the guide plate 6' by means of a second hinged connection 14.2. The connection between the telescoping rod arrangement 14.3 to the guide plate 6' is made in such a manner that the telescoping rod arrangement 14.3, by means of a pressure spring 14.4 mounted therein, exerts an essentially downward force on the second lever arm 15.2.

The second actuating force can also be realized by means of a weight applied to the second lever arm 15.2 instead of in the manner described above with the telescoping rod arrangement.

FIG. 2 shows a different embodiment of the end stops 11 or 11', although these can also be realized as in FIG. 1. In this embodiment, the angle lever arrangement 15 includes a third lever arm 15.3 which serves as a stop arm 11.3". Mounted to this arm 15.3 is a roll 11.1", which roll 11.1" rotates around a horizontal axis 11.2" and rolls along a vertical staying surface 11.4" when the stop 1 is in its alignment position, i.e. the stop face 1.1 is vertical. The staying surface 11.4" is realized by bending up one edge of the guide plate 6'. Also, the staying surface 11.4", as in the example shown in FIG. 1, runs essentially parallel to the side 7.1 of the pile which, when the stop 1 is properly located in its base position on its first level, prior to displacement by means of the pile carrier 12, is aligned against the stop face 1.1 of the stop 1.

FIG. 2 shows the device at one point in time while swinging the stop 1 around the geometric axis 3 toward the pile 7 by means of a moment applied in a clockwise direction, given the orientation of the side 7.1 of the pile as shown, by the common actuating device 14 to the angle lever arrangement 15. The swing is terminated when the roll 11.1" makes contact with the staying surface 11.4", staying this moment. The common actuating device 14 holds the stop 1 in the alignment position the stop now assumes and, as it did during the aforementioned swing, presses the stop against the pile support surface 12.1 when the stop 1 is in its alignment position on the second level.

In the example shown in FIG. 2, this is done by means of a roller arrangement 16 on the lower end 10 of the stop 1 which rolls along the pile supporting surface 12.1. This roller arrangement 16 reduces the required magnitude of the first actuating force by means of which the stop 1 can be swung and simultaneously raised into its alignment position on the second level.

Figure 3:
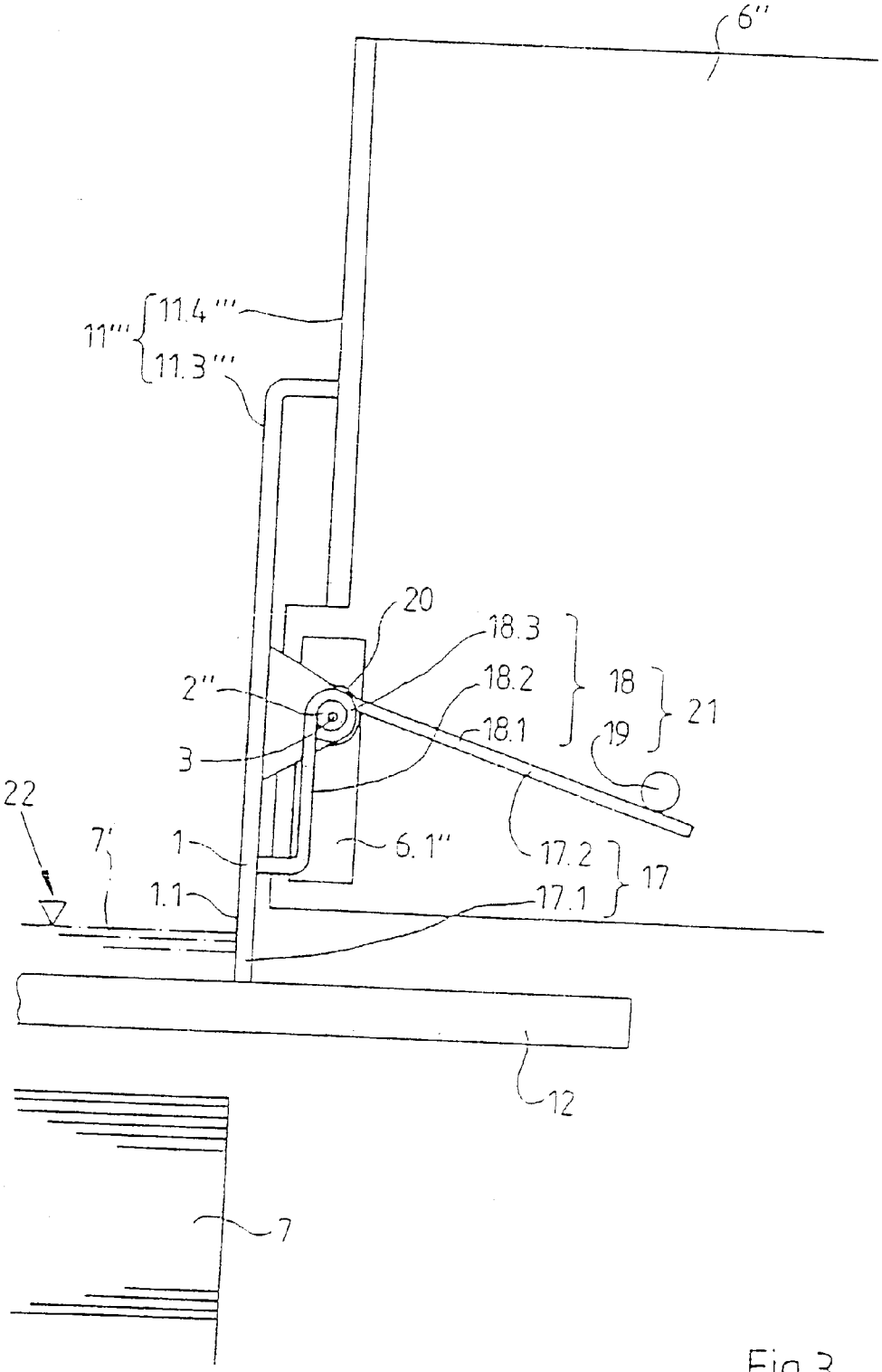
FIG. 3 shows a schematic of a second embodiment of the second variant.

FIG. 3 shows a second embodiment of the variant having a common actuating device at a phase in which the stop 1 is realized as the first lever 17.1 of an articulated lever arrangement 17, which stop 1 is in its alignment position slightly below its second level after a partial pile 7' aligned against the stop face 1.1 has begun to form on the pile carrier 12, which pile carrier 12 has moved downward to maintain the production level explained above and indicated with the mark 22. The articulated lever arrangement 17 comprises a first leg 18.1 of a leg spring 18, which leg 18.1 comprises the second lever 17.2 of the articulated lever arrangement 17 and extends away from the pile 7, or more precisely, from the partial pile 7'. The second leg 18.2 of the leg spring 18 rests against the side of the stop 1 facing away from the partial pile 7. The first lever 17.1 which forms the stop 1 can be swung around the geometric axis 3, which axis 3 is realized as an axle shaft 2". The leg spring 18 includes a coiled core 18.3, which core 18.3 is wound around the axle shaft 2' without being rigidly connected to the first lever 17.1 so that, as can be seen particularly clearly in FIGS. 4 through 8, the first leg 18.1 of the leg spring 18, which leg 18.1 is also the second lever 17.2 of the articulated lever arrangement 17, can be swung around the geometric axis 3 independent of the first lever 17.1 of the articulated lever arrangement 17. As the second lever 17.2, here in the form of the first leg 18.1 of the leg spring 18, can be swung independent of the first lever 17.1, therefore the first lever 17.1 and the second lever 17.2 may not be rigidly connected. Nonetheless, FIGS. 4 through 8 clearly indicate that there is a certain relationship between the swinging of the first lever 17.1 and the swinging of the second lever 17.2.

The leg spring 18, which is braced against the first lever 17.1 by means of its second leg 18.2, is braced against a support 19 by means of its first leg 18.1. This support 19 is stationary relative to a guide plate 6", by means of which the geometric axis 3 is guided in this example. Analogous to the example in FIG. 2, the guide plate 6" includes a vertical slot 6.1". In this case, however, the geometric axis 3 is coupled to this slot 6.1" by means of a roll barrel arrangement 20 in which the axle shaft 2" is mounted and which rolls along the guide realized as the slot 6.1". The horizontal alignment of the geometric axis 3 can be realized by means of wheel flanges on the roll barrel arrangement 20, for example.

The first lever 17.1 can be spread apart from the second lever 17.2 by means of the leg spring 18 braced against the support 19. In an alternative embodiment not shown here, this same effect can be produced by means of a pressure spring arrangement braced against the first lever 17.1 on one side and the second lever 17.2 on the other. In this alternative embodiment, the pressure spring arrangement is analogous to that in the telescoping rod arrangement 14.3, and the pressure spring 14.4 can be realized as a functional unit in the form of a helical spring as in the embodiment in FIG. 2 or in the form of a continuous rate pneumatic spring arrangement, for example.

In any case, the effect of the spreading thus achieved is that the stop 1 in the form of the first lever 17.1 swings away from the pile 7 against a first actuating force as a result of a corresponding excursion of the pile carrier 12. This same actuating force is used to swing the stop 1 back in the opposite direction while simultaneously raising the same to dislocate the stop 1 to its alignment position on the second level, which alignment position is determined by the height of the pile carrier 12. The fact that the second lever 17.2 is not rigidly connected to the support 19 ensures that the second lever 17.2 can swing around the geometric axis 3, which geometric axis 3 must move along the guide. The non-rigid connection of the second lever 17.2 to the support 19 is realized by means of the previously discussed spreading effect, specifically, as a result of a restoring force exerted by the second lever 17.2 against the support 19 in response to a first actuating force which spreads the first lever 17.1 apart from the second lever 17.2.

The swing of the stop 1 in the direction of the pile 7 is terminated and the alignment position of the stop 1 on its second level reached when a stop arm 11.3'", which swings together with the stop 1, rests against the vertical staying surface 11.4'" and the end stop 11'" thus formed is engaged. In this case, one edge of the guide plate 6" is also bent upward to form the staying surface 11.4'".

Once the stop 1 has reached its alignment position on the second level and, in the case of this example, while the stop is moved back to vertical from a position swung away from the pile 7, the leg spring 18 exerts a second actuating force against the stop 1 which presses the stop 1 against the pile carrier 12. This second actuating force is also a result of the spreading effect of the leg spring 18, which leg spring 18 is braced against both the support 19 so as to slide and against the stop 1. Together with the support 19, the leg spring 18 forms an actuating device 21 by means of which actuating device 21 both the first and second actuating forces can be generated, thus there is a common actuating device 21 for both actuating forces.

Because FIG. 3 is intended to show only one variant with respect to the common actuating device, the means shown in FIGS. 1 and 2 for reducing the said actuating forces by reducing friction, in particular on the staying surface 11.4'" and the pile carrier 12, are shown neither in this drawing nor in FIGS. 4 through 8.

FIGS. 4 through 8 show individual phases of the practical application of the device in accordance with the present invention as shown in FIG. 3. In this case, the device is used as a non-stop delivery unit of a sheet treatment machine, such as a sheet-fed printing press. In this case, the stop 1 serves to align the pile by aligning the side 7.1 of the pile facing the press.

In one possible variant of the non-stop delivery unit, a pile 7 of sheets 7.2 treated and discharged by the press is lowered once it has reached the maximum permissible pile height. A catch mechanism (not shown here) catches and temporarily holds the sheets 7.2 discharged in the meantime, and an empty pile carrier 12 is moved forward in the direction of the stop face 1.1 of the stop 1 to assume a pile position above the recessed pile 7.

Figure 4:
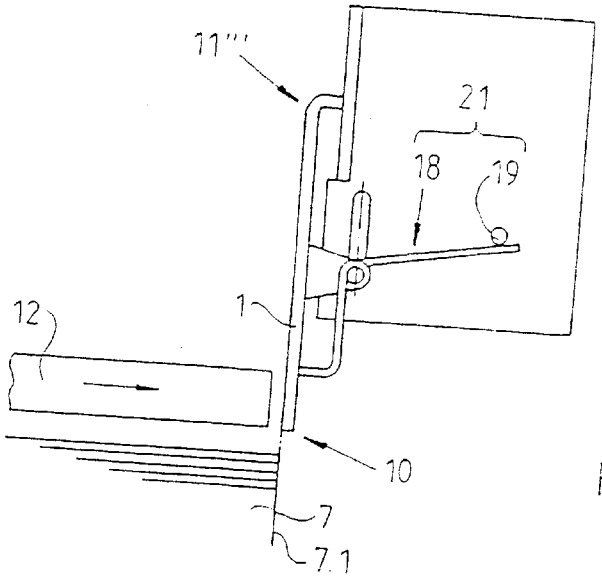
FIGS. 4–8 show, by example of the practical application of the embodiment shown in FIG. 3, the individual phases of the movement sequence of the device in accordance with the present invention.

As long as the pile carrier 12 has not yet reached the stop 1, the stop 1 is in its alignment position and first level as shown in FIG. 4.

Figure 5:
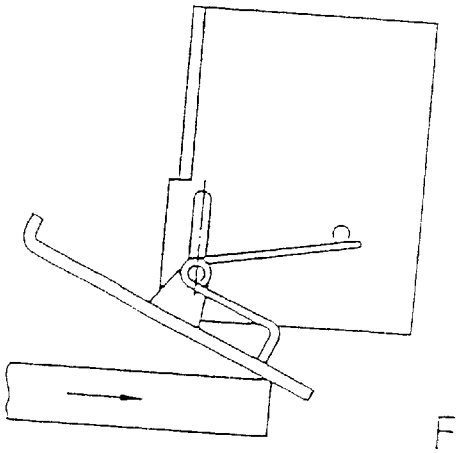

In the phase shown in FIG. 5, the pile carrier 12 has moved further forward and has swung the stop 1 away from the side 7.1 of the pile against a first actuating force generated by means of a leg spring 18.

Figure 6:
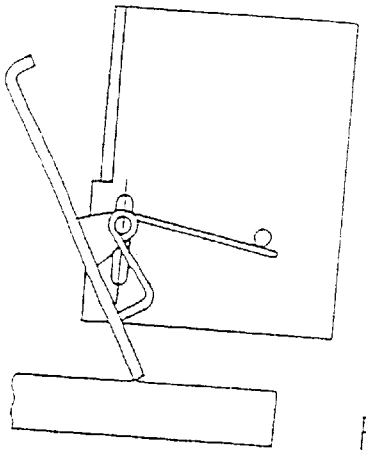

FIG. 6 shows a later phase in which the pile carrier 12 has moved to its end position beneath the stop 1 and the stop 1 has begun to swing back toward the side 7.1 of the pile under the first actuating force as the stop 1 is simultaneously raised.

Figure 7:
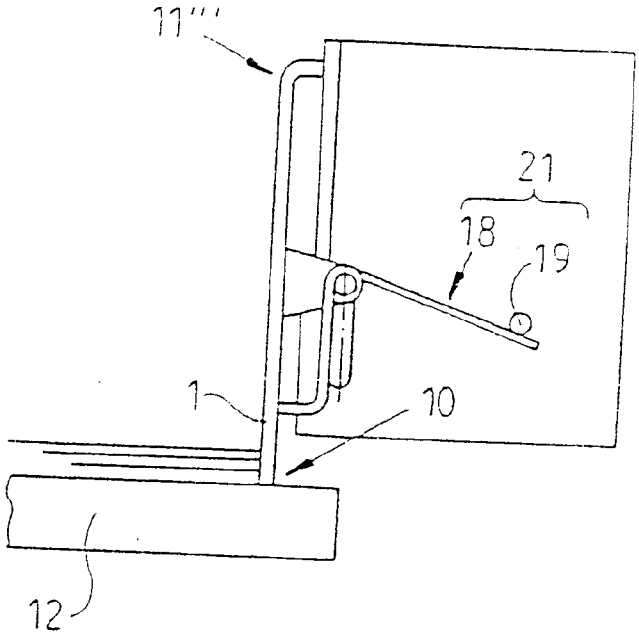

In the phase shown in FIG. 7, the swing in the direction of the side 7.1 of the pile has been terminated by the engagement of the end stop 11. The stop 1 is in its alignment position on its second level above its first level, and the sheets 7.2 held by the catch mechanism (not shown) are lowered unto the pile carrier 12 to form a partial pile 7 by withdrawing the catch mechanism from the pile 7 area.

While the pile carrier 12 is lowered as described above, and while the partial pile 7 continues to grow, the stop 1 remains in contact with the pile supporting surface 12.1 due to the effect of the second actuating force, which second actuating force is exerted by the leg spring 18 and pushes the stop 1 against the pile carrier 12. In other words, the stop 1 follows the pile carrier 12 as it is lowered due to this second actuating force. The first actuating force and the end stop 11'" ensure that the stop 1 retains its alignment position until reaching its first level.

Figure 8:
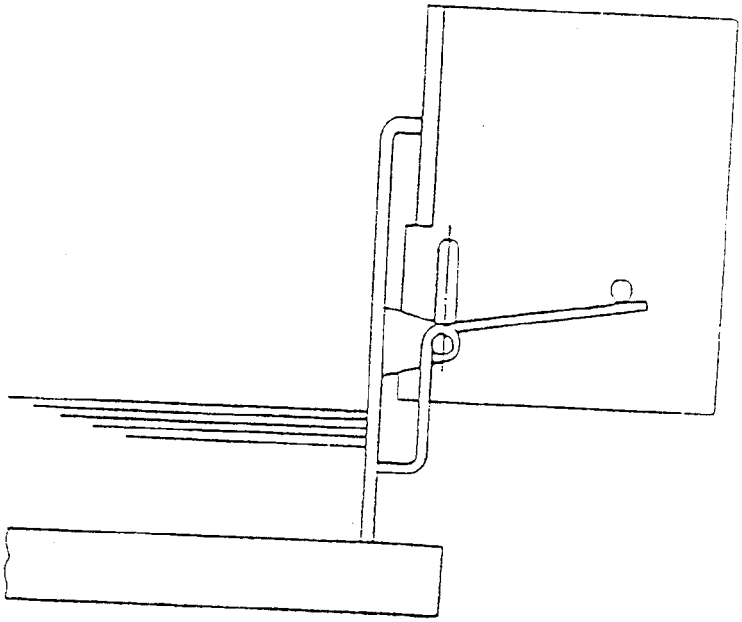

FIG. 8 shows the phase in which the lowering of the stop 1 from its second level to its first level ends and further lowering of the pile carrier 12 breaks the contact between the same and the lower end 10 of the stop 1. In this example, the first level is reached when the guide in the form of the slot 6.1" prevents further lowering of the axle shaft 2.

Analysis of the forces and moments involved with allowance for the prevailing effects of friction yields a geometry for the device with respect to the lengths of the levers 17.1 and 17.2; the distance from the point of contact of the stop arm 11.3'" with the staying surface 11.4'" from the geometric axis 3; and with respect to the angular positions of the levers 17.1 and 17.2 at the beginning and completion of the process for raising the stop, which ensures the proper execution of the sequence described with reference to FIGS. 4 through 8.

As previously mentioned, the above sequence applies to a practical application in which the stop 1 is swung away from the pile 7 due to the horizontal movement of the pile carrier 12 toward the stop 1, such as when forming a pile on cradle boards. However, the application of the device in accordance with the present invention are not limited to this case. The device can also be put to advantageous use together with an auxiliary device on which the sheets 7.2 are temporarily deposited in the form of a partial pile 7 before being subsequently lowered onto a height-adjustable pile carrier 12. Such an auxiliary device can be a catcher comprised of horizontal bars which can be moved longitudinally toward and away from the stop 1 and are perpendicular to the stop face 1.1 of the stop 1 when the latter is in its alignment position.

When used with such a catch mechanism, which is not shown in any detail in FIG. 9, the stop 1 can be dimensioned so that it fits between adjacent bars and when at its first level, extends through the catcher so that the lower end 10 of the stop 1 is below the bars 23.

Figure 9:
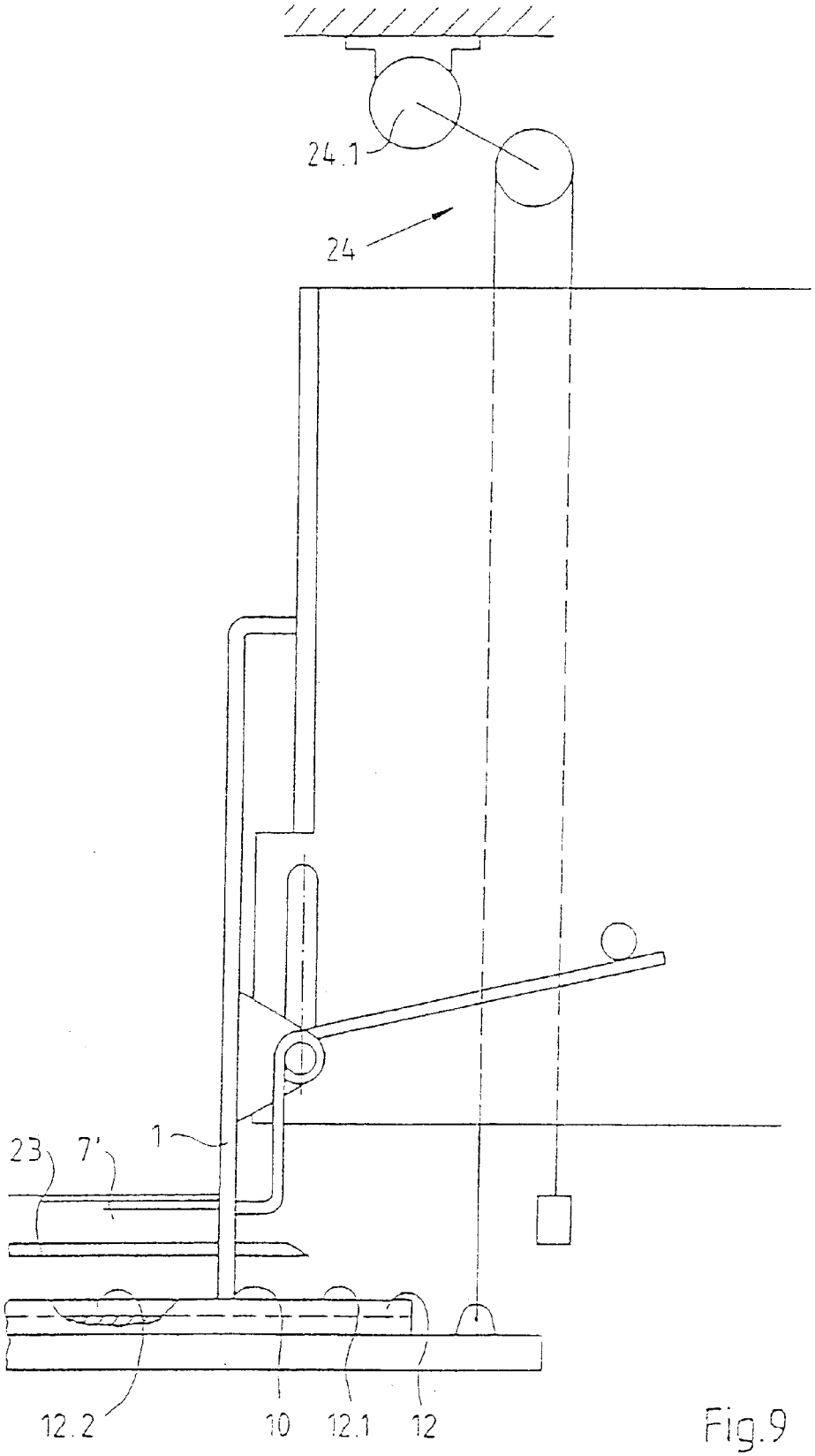
FIG. 9 shows another practical application of the device in the embodiment shown in FIG. 3.

The variant shown in FIG. 3 is used in FIG. 9 to illustrate the use of the device in conjunction with such a catch mechanism. Height adjustment of the pile carrier 12 is realized by means of a chain hoisting device 24 (shown schematically) driven by a drive unit 24.1.

In the phase shown in FIG. 9, the height-adjustable pile carrier 12 has reached a height at which the pile supporting surface 12.1 just touches the lower end 10 of the stop 1, which is in its alignment position on its first level.

Grooves 12.2 in the pile supporting surface 12.1 are realized so that the bars 23 can be lowered into the pile carrier 12 so as to be at least flush with the pile supporting surface 12.1. In another phase, the pile carrier 12 is raised so high that the bars 23 recede into the grooves 12.2 so that the partial pile 7 rests on the pile supporting surface 12.1 and the bars 23 can be withdrawn longitudinally from under the partial pile 7. During the phase in which the pile carrier 12 is being raised, the pile carrier 12 itself raises the stop 1 to its second level, which second level is reached at the end of this phase. The stop 1 remains in its alignment position assumed on the first level.

The device in accordance with the present invention can be used to particular advantage in a delivery unit 25.1 which piles the sheets 7.2 on a pile carrier 12 for a machine 25 which discharges the sheets. An example of such a machine would be a sheet-fed, rotary offset press.

Figure 10:
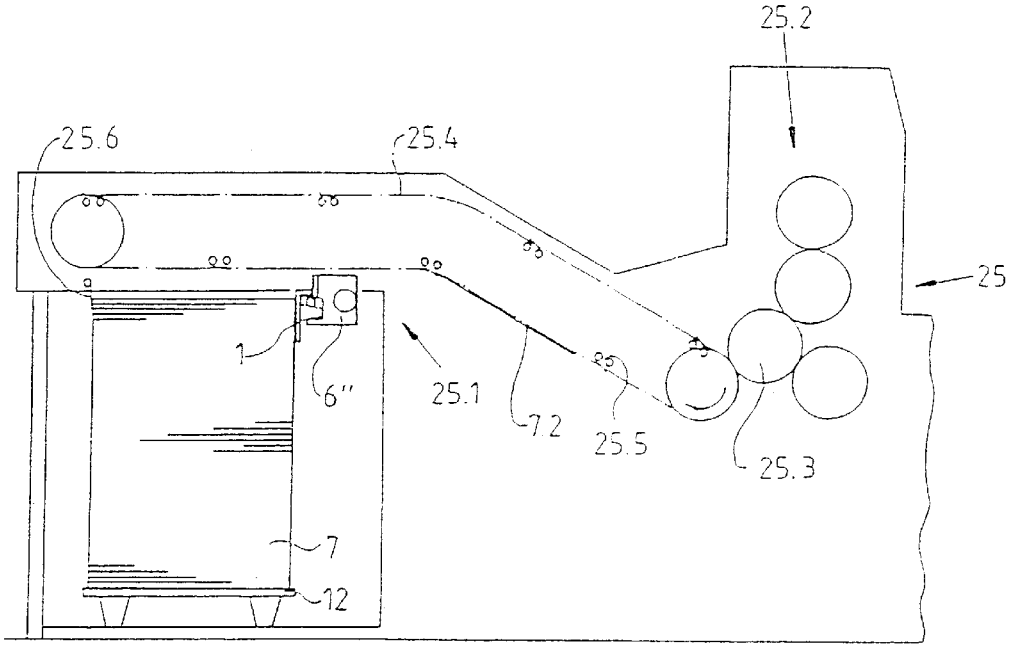
FIG. 10 is a schematic of the printing unit of a rotary press with an attached chain delivery unit, which stacks the sheets delivered by the press using the device in accordance with the present invention.

The delivery unit 25.1 in the form of a chain delivery unit and an upstream printing unit 25.2 of such a sheet-fed rotary offset press 25 are shown schematically in FIG. 10. The printing unit 25.2 comprises, in particular, a counterpressure cylinder 25.3 to guide the sheets 7.2, immediately downstream of which the delivery unit 25.1 is located. The delivery unit 25.1 comprises an endless chain conveyor 25.4 to which grippers 25.5 are coupled. As the grippers 25.5 pass the counterpressure cylinder 25.3, they pick up a printed sheet 7.2 by grabbing its leading edge, carry the sheet 7.2 along the lower leg of the endless chain conveyor 25.4 (as shown in FIG. 10) toward the pile 7, and release the sheet above the pile 7 in such a manner that as the sheet 7.2 falls, the leading edge of the same rests against a front edge stop 25.6. Opposite this front edge stop 25.6 is the stop 1, which aligns the trailing edge of the sheets 7.2. That embodiment shown in FIG. 3 of the device in accordance with the present invention comprising the stop 1 is shown in greatly simplified form in FIG. 10. The circle shown in FIG. 10 near the guide plate 6" represents a sheet brake, e.g. suction rolls, by means of which sheet brake the sheets 7.2 transported by grippers 25.5 at the speed of the press are slowed to a delivery speed following their release.

One feature of the invention resides broadly in the device for forming a pile 7 of sheets 7.2 having a pile carrier 12 with a pile supporting surface 12.1 and a stop 1, which stop 1 can be raised from an alignment position on a first level to an alignment position on a second level while retaining its axial alignment in that the stop 1 is first swung around a horizontal geometric axis 3 and away from the pile 7 against a first actuating force and then swung by means of the first actuating force toward the pile 7, and which stop is, at least in the alignment position on the second level, pressed against the pile supporting surface 12.1 by means of a second actuating force, characterized by the fact that:—a guide slot 6.1; 6.1'; 6.1" forces a vertical dislocation of the geometric axis 3 during the dislocation-of the stop 1, and— an end stop 11, 11', 11", 11'" by means of which the stop is held in the same alignment under the influence of the first actuating force on the first, second and every intermediate level.

Another feature of the invention resides broadly in the device characterized by the fact that the first actuating force is generated by a first actuating device 8 and the second actuating force is generated by a second actuating device 9 which is independent of the first actuating device 8.

Yet another feature of the invention resides broadly in the device characterized by the fact that the first and second actuating forces are generated by a common actuating device 14, 21.

Still another feature of the invention resides broadly in the device characterized by an angle lever arrangement 15 which can swing around the geometric axis 3 has at least two lever arms 15.1, 15.2, the first lever arm 15.1 of which forms the stop 1, and the second lever arm 15.2 of which is acted upon by the common actuating device 14.

A further feature of the invention resides broadly in the device characterized by the fact that:—there is an articulated lever arrangement 17 having a first lever 17.1 which forms the stop 1 and can be swung around the geometric axis 3, and a second lever 17.2 running away from the pile 7 which can be swung around the geometric axis 3 independent of the first geometric axis 17.1,—the first lever 17.1 is spread apart from the second lever 17.2 by means of the common actuating device 21, and—the second lever 17.2 is displaceably braced against a fixed support 19.

Another feature of the invention resides broadly in the device characterized by the fact that the stop 1 bears at its lower end 10 a roller arrangement 16 which rolls along the pile supporting surface 12.1.

Yet another feature of the invention resides broadly in the device characterized by the fact that the stop 1 is coupled to the guide slot 6.1 by means of a roll barrel arrangement 20 which rolls along the guide slot 6.1.

Still another feature of the invention resides broadly in the device characterized by the fact that the end stop 11, 11, 11 comprises a roll barrel arrangement 11.4, 11.4, 11.4 which can be swung and dislocated together with the stop 1, and a vertical support surface 11.4, 11.4, 11.4 along which the roll barrel arrangement axle 11.2, 11.2, 11.2; roll 11.1, 11.1, 11.1 rolls.

A further feature of the invention resides broadly in the device characterized by the use of the pile carrier 12 to swing the stop 1 away from the pile 7.

Another feature of the invention resides broadly in the device having a height-adjustable pile carrier 12, characterized by the use of the pile carrier 12 to raise the stop 1 from its first level to its second level while retaining the alignment of the stop 1.

Yet another feature of the invention resides broadly in the device characterized by the use in a delivery unit 25.1 of a sheet-fed rotary press 25 for piling sheets 7.2 on the pile carrier 12 with the stop 1 arranged in such a manner that it serves as an alignment means for the corresponding edges of the sheets 7.2 forming the pile 7.

An example of a printing press in which the present invention could be utilized can be found in U.S. Pat. No. 5,102,117, issued to Henn et al. on Apr. 7, 1992. Specifically, the present invention could be used in a manner analagous to the stop board indicated as item number 49 in FIG. 2 of U.S. Pat. No. 5,102,117.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, and patent applications recited herein, and in the Declaration attached hereto, are hereby incorporated by reference as if set forth in their entirety herein.

The corresponding foreign patent publication applications, namely, Federal Republic of Germany Patent Application No. 196 39 495.3, filed on Sep. 26, 1996, having inventor Frank Gunschera, and DE-OS 196 39 495.3 and DE-PS 196 39 495.3, as well as their published equivalents, and other equivalents or corresponding applications, if any, in corresponding cases in the Federal Republic of Germany and elsewhere, and are hereby incorporated by reference as if set forth in their entirety herein.

Examples of printing machines with devices for forming sheet piles, and structures related thereto, may be found in the following U.S. Pat. Nos. 5,377,587; 5,377,588; 5,390,911; 5,398,931; 5,407,189; 5,409,208; 5,411,251; 5,419,542; 5,423,656; 5,445,372; 5,447,102; 5,447,300; 5,467,710; and 5,476,361. The above patents are incorporated by reference in their entirety herein.

Further examples of devices for forming sheet piles may be found in the following U.S. Pat. Nos. 4,830,355; 4,854,231; 5,546,858; 5,659,178; 5,096,179; 5,102,117; 5,054,765; 5.090,681; 5,170,706; and 5,259,608. The above patents are incorporated by reference in their entirety herein.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A device for forming a pile of sheets comprising:

a pile carrier;

said pile carrier comprising a pile supporting surface to receive sheets;

a stop;

said device for forming a pile of sheets defining an axis, the axis having an orientation in said device;

said stop being configured and being disposed in said device for forming a pile of sheets so as to be pivotable with respect to the axis;

a linear guide to guide the axis;

said stop having a first alignment position on a first level relative to said linear guide and a second alignment position on a second level relative to said linear guide;

structure to generate a first actuating force to pivot said stop about the axis;

structure to generate a second actuating force to move said stop from the second alignment position toward the first alignment position;

structure to pivot said stop around the axis and away from said pile against the first actuating force;

said stop being configured to be raised from the first alignment position to the second alignment position and configured to retain the orientation of the axis by said stop being pivoted around the axis and away from said pile against the first actuating force, said stop being further configured to then be pivoted by said structure to generate a first actuating force toward said pile;

said stop being configured to be pressed against the pile supporting surface by said structure to generate a second actuating force upon said stop being in the second alignment position;

said linear guide being configured and disposed to force a linear vertical dislocation of the axis upon movement of said stop;

an end stop;

said end stop comprising a vertical support surface; and said vertical support surface of said end stop being disposed to limit pivoting of said stop to align said stop substantially identically under the influence of the first actuating force at the first and second levels and at every intermediate position of said stop between the first level and the second level.

2. The device as claimed in claim 1 wherein said axis is a horizontal geometric axis.

3. The device as claimed in claim 2, wherein said structure to generate a second actuating force is independent of said structure to generate a first actuating force.

4. The device as claimed in claim 2, wherein said structure to generate a first actuating force and said structure to generate a second actuating force comprise a single structure to generate the first and second actuating forces.

5. The device as claimed in claim 4, comprising:

an angle lever arrangement;

said angle lever arrangement being disposed to pivot around the geometric axis;

said angle lever arrangement comprising at least two lever arms;

said at least two lever arms comprising a first lever arm and a second lever arm;

said first lever arm comprising said stop; and said second lever arm being disposed and configured to be acted upon by said single structure to generate the first and second actuating forces.

6. The device as claimed in claim 4, comprising:

an articulated lever arrangement;

said articulated lever arrangement comprising a first lever which forms the stop and can be pivoted around the geometric axis, and a second lever, said second lever being disposed at an angle with respect to said first lever, which can be pivoted around the geometric axis independent of the first lever;

said common actuating device is configured and disposed to displace said first lever with respect to said second lever; and said second lever is displaceably braced against a fixed support.

7. The device as claimed in claim 2, wherein said stop comprises a roller arrangement, said roller arrangement being disposed at the lower end of said stop, and said roller arrangement being disposed to roll along the pile supporting surface.

8. The device as claimed in claim 2, wherein said stop comprises a roll barrel arrangement; and said roll barrel arrangement being disposed to roll along said linear guide to move said stop along said linear guide.

9. The device as claimed in claim 2, wherein said end stop comprises a roll barrel arrangement, said roll barrel arrangement being operatively connected to said stop to be pivoted and dislocated together with the stop, said roll barrel arrangement being disposed to roll along said vertical support surface of said end stop.

10. The device as claimed in claim 2, wherein said pile carrier is configured and disposed to pivot said stop away from sheets received by the device.

11. The device as claimed in claim 2, wherein:

said pile carrier, is configured to have an adjustable height relative to said guide; and said pile carrier is configured and disposed to raise the stop from its first alignment position on the first level to its second alignment position on the second level while retaining the alignment of said stop.

12. The device as claimed in claim 2 for use in a delivery unit of a sheet-fed rotary press wherein said stop is configured and disposed to align the corresponding edges of the sheets being received by the device to receive sheets to form a pile.

* * * * *

UNITED STATES PATENT AND TRADEMARK OFFICE

CERTIFICATE OF CORRECTION

PATENT NO. : 6,510,792 B1
DATED : January 28, 2003
INVENTOR(S) : Frank Gunschera It is certified that error appears in the above-identified patent and that said Letters Patent is hereby corrected as shown below:

Column 2,
Line 26, before the first occurrence of "and", delete "patentable" and insert -- patentably --.

Column 3,
Line 25, after the first occurrence of "the" delete "."

Column 10,
Lines 29 and 30, after "5,259,608." delete "The above patents are incorporated by reference in their entirety herein."
Lines 30 and 31, insert the following paragraph:
-- The details in the patents, patent applications and publications may be considered to be incorporable, at applicant's option, into the claims during prosecution as further limitations in the claims to patentably distinguish any amended claims from any applied prior art. --.

Signed and Sealed this

Fifth Day of August, 2003

JAMES E. ROGAN
*Director of the United States Patent and Trademark Office*